US011299247B1

(12) United States Patent
Staigerwald

(10) Patent No.: US 11,299,247 B1
(45) Date of Patent: Apr. 12, 2022

(54) WATERCRAFT PADDLE WITH DRIP DIVERTING EDGE

(71) Applicant: John W. Staigerwald, Pearland, TX (US)

(72) Inventor: John W. Staigerwald, Pearland, TX (US)

( * ) Notice: Subject to any disclaimer, the term of this patent is extended or adjusted under 35 U.S.C. 154(b) by 0 days.

(21) Appl. No.: 16/565,846

(22) Filed: Sep. 10, 2019

Related U.S. Application Data

(60) Provisional application No. 62/730,264, filed on Sep. 12, 2018.

(51) Int. Cl.
*B63H 16/04* (2006.01)

(52) U.S. Cl.
CPC ..... *B63H 16/04* (2013.01)

(58) Field of Classification Search
CPC ..... B63H 16/04; B63H 2016/04
USPC ..... 440/101
See application file for complete search history.

(56) References Cited

U.S. PATENT DOCUMENTS

| | | | | | |
|---|---|---|---|---|---|
| 3,030,641 | A * | 4/1962 | Ake | B63H 16/04 | 416/71 |
| 3,040,693 | A * | 6/1962 | Bunker | B63H 16/04 | 114/221 R |
| D216,227 | S * | 12/1969 | Nichols | D12/215 | |
| 5,163,778 | A * | 11/1992 | Botero | B63B 13/00 | 114/221 R |
| D335,274 | S * | 5/1993 | Beckerer, Jr. | D12/215 | |
| 5,851,132 | A | 12/1998 | Merrill | | |
| 7,396,266 | B1 | 7/2008 | Woods | | |
| D578,055 | S | 10/2008 | Halm | | |
| 8,632,371 | B1 | 1/2014 | Ramsey | | |
| D869,369 | S * | 12/2019 | Rogers | B63B 13/00 | D12/215 |
| 2015/0118924 | A1 | 4/2015 | Hess | | |

* cited by examiner

*Primary Examiner* — Daniel V Venne
(74) *Attorney, Agent, or Firm* — Kenneth A. Roddy

(57) ABSTRACT

A single or double bladed watercraft paddle having an improved blade with a bottom edge configured to divert water flow off of a raised paddle blade to reduce the likelihood of it flowing or dripping into the watercraft, onto the paddler, or onto the paddler hands. In one embodiment, the bottom edge of the paddle blade is provided with a notch or plurality of adjacent notches, in another embodiment, the bottom edge of the paddle blade is provided with a protrusion or plurality of adjacent protrusions, and in another embodiment the bottom edge of the paddle blade is provided with a combination of adjacent notches and protrusions. The notches and protrusions may be of various shapes and sizes.

5 Claims, 3 Drawing Sheets

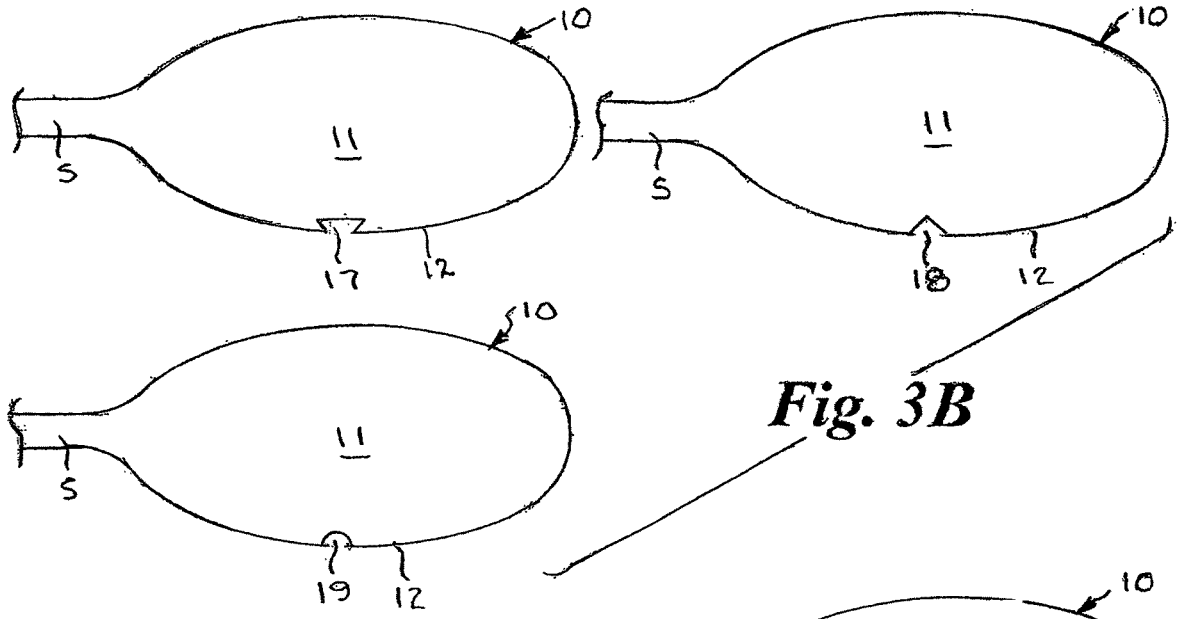
Fig. 3B
Fig. 3C
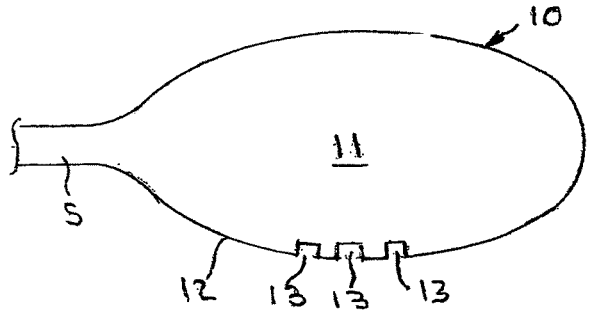
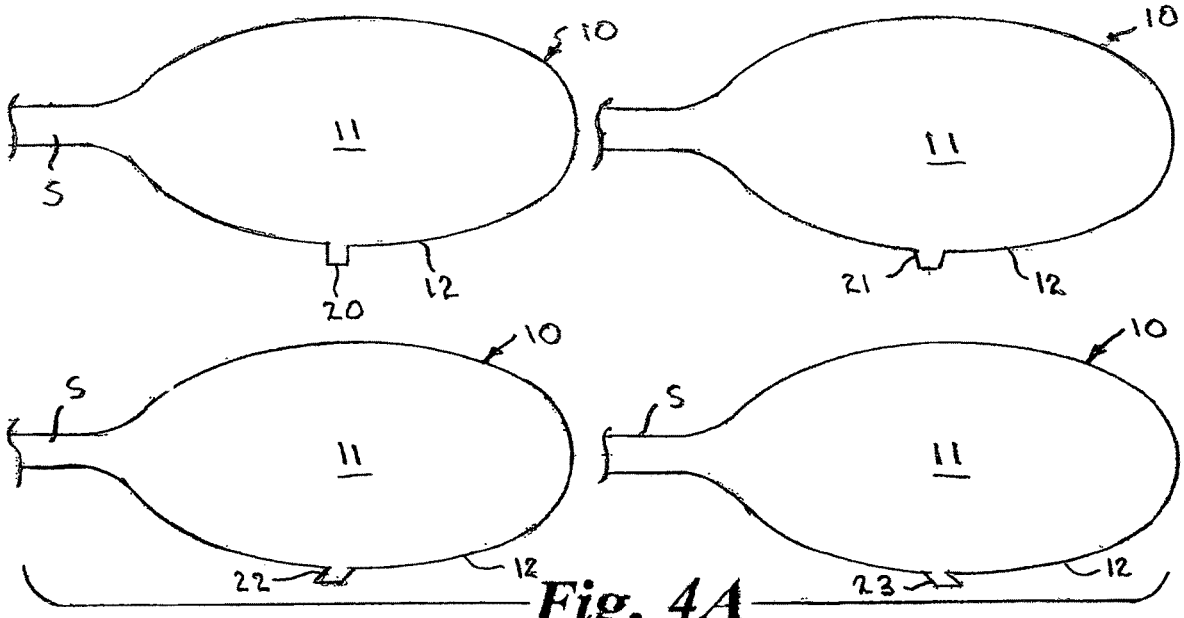
Fig. 4A

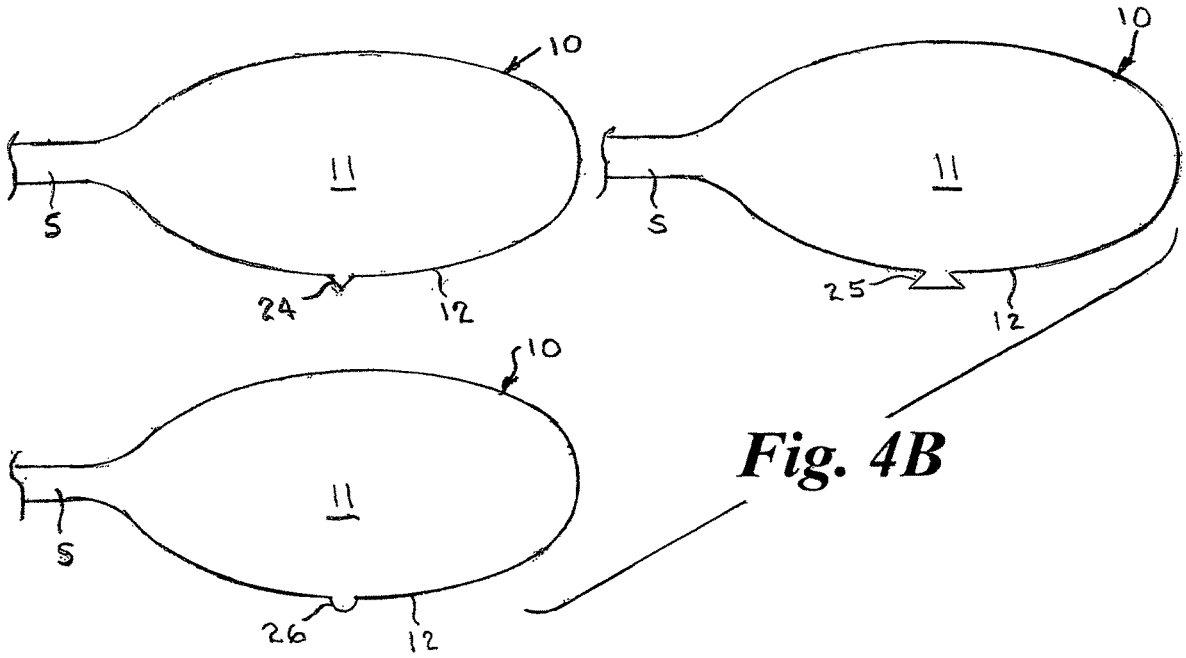
Fig. 4B
Fig. 4C
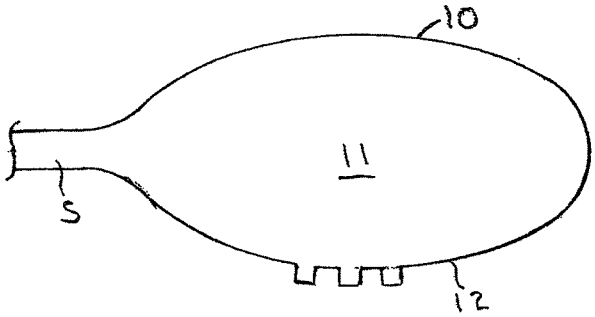
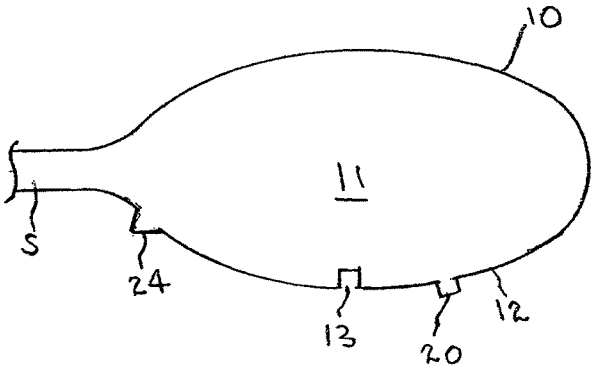
Fig. 5

WATERCRAFT PADDLE WITH DRIP DIVERTING EDGE

CROSS REFERENCE TO RELATED APPLICATION

This application claims priority of U.S. Provisional Application Ser. No. 62/730,264, filed on Sep. 12, 2018.

BACKGROUND OF THE INVENTION

1. Field of the Invention

This invention relates generally to the field of human powered watercraft paddles of the type used for paddling canoes, kayaks, paddleboards, and various other watercraft and, more particularly, to a single or double bladed watercraft paddle having an improved blade with a bottom edge configured to divert water flow off of a raised blade to reduce the likelihood of it flowing or dripping into the watercraft, onto the paddler, or onto the paddler's hands.

2. Background Art

Watercraft paddles used for paddling canoes, kayaks, paddleboards, and various other human powered watercraft have been known for many years and are offered commercially by several manufacturers. Commercial kayak paddle offerings vary based on many factors including, by way of example, material of construction, configuration, intended use, and cost.

A typical conventional double bladed kayak paddle, as shown in FIG. 1, comprises a paddle shaft S which connects two paddle blades B. The paddle blades B are typically permanently attached to the paddle shaft. The paddle shaft S may be a single piece or multiple pieces joined by a ferrule F and is of sufficient length to be gripped by one or both hands of a paddler. Many canoe enthusiasts have discovered that a double bladed kayak paddle can work well for solo canoe trips because it is less fatiguing to use and works well for balanced paddling, helping keep the canoe in a straight line. A conventional canoe paddle differs from a kayak paddle in that it has an elongated shaft S, usually integral with a single blade B, and a grip, also called a palm grip, on the end of the shaft opposite the blade.

As illustrated in FIG. 2, one of the major problems with conventional single or double paddle blades is that when the paddle blade B is elevated from the water above a horizontal plane, water will cohere to the paddle blade from whence it will flow downward along the paddle blade to the bottom longitudinal bottom edge BE of the paddle blade. When the paddle S shaft is raised angularly above a horizontal position, the water on the elevated paddle blade will continue to flow vertically and accumulate on the bottom edge BE of the paddle blade B from whence it will continue to flow toward the outer edge of the corresponding paddle shaft S. As represented by arrows W, if unaffected, the water from the elevated paddle blade will continue flow down the paddle shaft onto the paddler, and/or the paddler's hands, and/or the watercraft.

This situation is frequently addressed in commercial paddles by using manufacturer installed drip rings or aftermarket drip rings R made of rubber or similar materials which encircle the paddle shaft and deflect the water off of the paddle shaft. Such drip rings R are typically located at the outer portion of the paddle shaft and in close proximity to the paddle blade (FIG. 1). Although typical drip rings for paddle shafts provide some degree of water deflection away from the paddle user's hand on the paddle shaft, they often still allow water to drip off onto the user or inside the watercraft.

There are several patents and published patent applications that disclose watercraft paddles and drip barriers of various designs and construction. The following are several examples.

Halm, U.S. Design Pat. D578,055, is directed toward the ornamental design for a kayak, canoe, and boat paddle that has a plurality of small V-shaped notches defining teeth extending along a portion of the curved distal end of the blade and a large J-shape cutout on the side of the blade edge opposite the curved toothed surface defining a hook. This product is commercially marketed as The Backwater Assassin Carbon Fiber Hybrid Paddle with a patented "hook and teeth" blade design. The hook serves as an extension to grab line, pull closer to a dock, capture decoys and pull down tree limbs when a line is snagged. The integrated teeth on the blade provide traction when launching from rocky or muddy shores or pushing off after getting stuck in shallow water.

Merrill, U.S. Pat. No. 5,851,132, discloses an improved kayak paddle for recreational or competitive paddling, which has handles affixed perpendicular to the shaft or shafts that rotate on axles as the paddle is used, to reduce twisting of the wrists and other joints of the paddler and improve efficiency and comfort. The shape of the paddle blades is shown to be quadrilateral such that water falls off the corner of the blades and does not run down the shaft to wet the hands of the paddler.

Woods, U.S. Pat. No. 7,396,266, discloses a drip barrier for watercraft paddles that is positioned between the grip position of the shaft and the blade which includes a base surrounding the shaft, and a concave sidewall portion extending vertically from the base toward the blade and curved laterally inward toward the shaft to define a water collection reservoir with the base for collecting water drippage from the blade along the shaft. The concave sidewall portion may have an arc length spanning greater than ninety degrees.

Ramsey, U.S. Pat. No. 8,632,371, discloses a transformative kayak paddle capable of becoming an oar or a paddleboard paddle. The kayak paddle includes a first paddle blade that includes a notched end on a distal end of the blade, which is characterized for use in pushing off of a stationary object. The first paddle blade also includes a pull notch that is oriented opposite the notched end at the juncture of the blade and shaft, and is suited for pulling action with respect to a stationary object. An extension shaft and a second shaft member are included in order to transform the kayak paddle to a paddleboard paddle. A second paddle blade is provided on the second shaft member and features a finger grip opening that enables an end user to articulate the device as a paddleboard paddle.

Hess, U.S. Published Patent Application 2015/0118924, discloses an improved kayak paddle which includes one or more substantially linear protrusions along the top and/or bottom edges of the paddle blades to impede the flow of water over the blades. The protrusions are on the top edges of the front faces of the blades and on the bottom edges of the rear faces of the blades to allow the same features to be facing the user upon a full one hundred eighty (180) degree rotation of the paddle about its axis. In a preferred embodiment, the paddle has two transitional sections located between one of the two blades and the shaft; and four protrusions, two substantially linear protrusions located on the front blade face of the two blades adjacent the top blade edge, and two substantially linear protrusions located on the rear blade face of the two blades adjacent the bottom blade edge, each of the four protrusions having a length slightly greater than one half of the length of one of the two blades.

SUMMARY OF THE INVENTION

The present invention overcomes the aforementioned problems and is distinguished over the prior art in general, and these patents in particular, by a single or double bladed watercraft paddle having an improved blade with a bottom edge configured to divert water flow off of a raised paddle blade to reduce the likelihood of it flowing or dripping into the watercraft, onto the paddler, or onto the paddler's hands. In one embodiment, the bottom edge of the paddle blade is provided with a notch or plurality of adjacent notches, in another embodiment, the bottom edge of the paddle blade is provided with a protrusion or plurality of adjacent protrusions, and in another embodiment the bottom edge of the paddle blade is provided with a combination of adjacent notches and protrusions, or at least one notch or protrusion may be located at the juncture of the shaft and the longitudinal bottom edge of the blade. The notches and protrusions may be of various shapes and sizes.

BRIEF DESCRIPTION OF THE DRAWINGS

FIGS. 3A and 3B are side elevation views of an embodiment of a paddle blade in accordance with the present invention having a bottom edge provided with a recessed notch configured to divert water flow off of the blade in a raised position. Notches of various shapes are illustrated.

FIG. 3C is a side elevation view of a modification of the paddle blade embodiment of FIGS. 3A and 3B having a plurality of adjacent notches along the bottom edge with notches of various shapes illustrated.

FIGS. 4A and 4B are side elevation views of an embodiment of the paddle blade in accordance with the present invention having a bottom edge provided with a protrusion configured to divert water flow off of the blade in a raised position. Protrusions of various shapes are illustrated.

FIG. 4C is a side elevation view of a modification of the paddle blade embodiment of FIGS. 4A and 4B having a plurality of adjacent protrusions along the bottom edge with protrusions of various shapes illustrated.

FIG. 5 is a side elevation view of a modification of the paddle blade having a combination of adjacent notches and protrusions selected from the embodiments of FIGS. 3A and 3B, and FIGS. 4A and 4B.

DETAILED DESCRIPTION OF THE INVENTION

Figure 1:
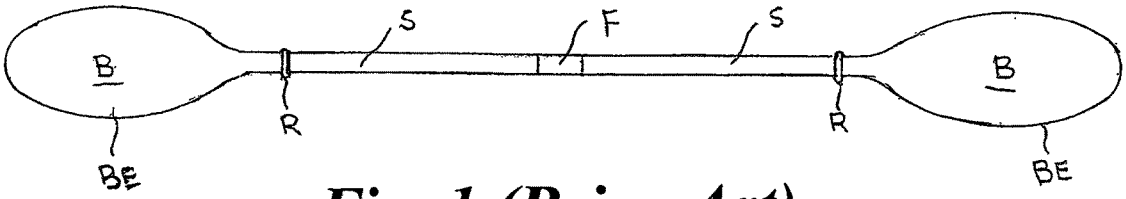
Fig. 1 (Prior Art)
FIG. 1 is a side elevation view of a conventional double bladed kayak paddle of the prior art showing the basic components.

As used in conjunction with the present invention, the following terms have the following meanings as shown in the drawings and related to a paddler of a watercraft holding a paddle in front of him or her in a paddle rest position. The term "paddle blade" is meant to encompass the blade of either a single or double blade paddle. The "front face" of the blade is the surface of the blade facing the paddler, and the "rear face" of the blade is the surface facing away from the paddler. The "top edge" of the blade is the top longitudinal edge, and the "bottom edge" of the blade is the opposed longitudinal edge. In some paddles, the top edge of the blades may be longer than the bottom edge. The "width" of a blade is the distance between the top longitudinal edge and the bottom longitudinal edge of the blade. The blade "thickness" is the distance between the front face and the rear face and the thickness may vary depending on the location where the thickness is being measured.

The term "notch" means an indentation, recess, or incision on an edge or surface. The term "protrusion" means something that projects or sticks out from an edge or surface. The term "integrally formed" means a part of a whole, or contained within it, more particularly, something that is formed as an inseparable part of a component during a machining or molding operation.

Figure 3A:
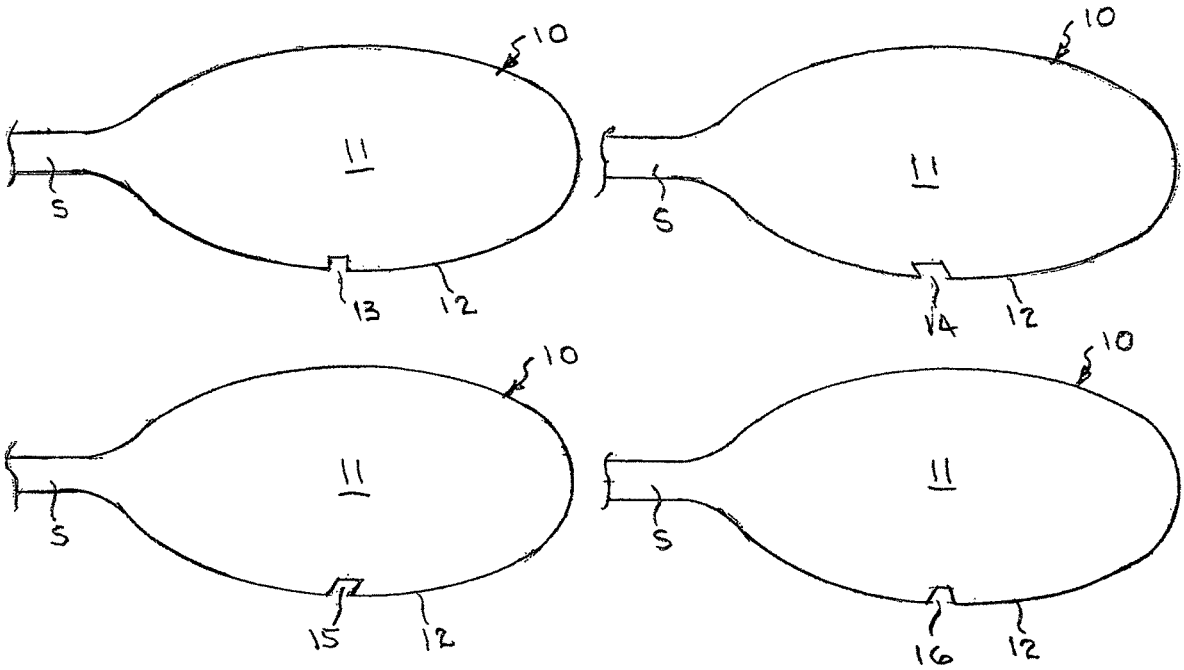

Referring now to FIGS. 3A and 3B of the drawings by numerals of reference, one end portion of a single or double bladed watercraft paddle 10, such as a canoe or kayak paddle, in accordance with the present invention. It should be understood that in a double bladed embodiment, the opposed end portion may be a mirror image thereof, as shown in FIG. 1. The present single or double bladed watercraft paddle 10, includes a paddle shaft S to which a single blade or two paddle blades 11 (one of which is shown) are attached. The paddle blade or blades 11 are typically permanently attached to the paddle shaft. The paddle shaft S may be a single piece or multiple pieces joined by a ferrule F as shown in FIG. 1 and described previously, and is of sufficient length to be gripped by one or both hands of a paddler.

Notches

As shown in FIGS. 3A and 3B, the paddle blade 11 is provided with a notch which is cut or integrally formed at a location along a portion of the longitudinal bottom edge 12 of the blade. Several examples of notches are shown. The shape of the notch may be a square or rectangular notch 13 having two straight parallel side walls adjoining a straight end wall, a trapezoidal notch 14 having two straight parallel side walls extending angularly inward in the direction toward the shaft and adjoining a straight end wall, a notch 15 having two straight parallel side walls extending angularly inward in the direction away from the shaft adjoining a straight end wall, a notch 16 having two straight side walls extending angularly inward and adjoining a straight end wall at an obtuse angle, a trapezoidal notch 17 having two straight side walls extending angularly inward and adjoining a straight end wall at an acute angle, a triangular notch 18 having two straight side walls extending angularly inward converging at an apex, or may be an inwardly curved or concave arcuate notch 19. It should be understood that the juncture of the walls of the notches may be smoothly rounded to avoid sharp edges.

The dimensions of the notch(s) are generally 0.25 inches wide as measured tangentially along the bottom edge 12 of the paddle blade and 0.25 inches in length as measured normal to the bottom edge of the paddle blade. However, it should be understood that either or both notch dimensions may be increased or decreased from the referenced 0.25 inches. While the thickness of the notches is the same as the thickness of the paddle blade (as measured at the lower edge of the paddle blade), the thickness may be increased or decreased.

FIG. 3C illustrates a modification of the paddle blade embodiments of FIGS. 3A and 3B, having a plurality of adjacent notches along the bottom edge 12 of the blade. For purposes of example, three adjacent square notches 13 having two straight parallel side walls adjoining a straight end wall is shown. However, it should be understood that the plurality of notches may comprise any of the shapes described previously, or combinations thereof.

Increasing the number of notches allows further discretion as to where the water is diverted and removed from the paddle blade. Notches located away from the paddle shaft will result in the removed water falling farther away from the paddler. Thus, the notch or notches are preferably located along the middle portion of the longitudinal bottom edge 12 of the blade, however, it should be understood that the notches may be located on the longitudinal bottom edge near its juncture with the shaft of the paddle, or at least one notch located at the juncture of the shaft and the longitudinal bottom edge of the blade.

Protrusions

Referring now to FIGS. 4A and 4B of the drawings by numerals of reference, one end portion of another embodiment of the paddle blade 11 of a single or double bladed watercraft paddle 10 such as a canoe or kayak paddle, in accordance with the present invention having a longitudinal bottom edge provided with a protrusion at a location along a portion thereof that juts laterally outward a distance beyond the periphery thereof configured to divert water flow off of the blade in a raised position. It should be understood that in a double bladed embodiment, the opposed end portion may be a mirror image thereof, as shown in FIG. 1. Several different examples of protrusions of various shapes are shown.

The shape of the protrusions may be a square or rectangular protrusion 20 having two straight parallel side walls extending outwardly from the longitudinal bottom edge 12 of the blade 11 and terminating in a straight end wall, a wedge shaped protrusion 21 having two straight side walls extending outwardly from the bottom edge and angularly toward each other terminating in a straight outer end wall, a trapezoidal protrusion 22 having two straight parallel side walls extending angularly outward in the direction toward the shaft and adjoining a straight outer end wall, a trapezoidal protrusion 23 having two straight parallel side walls extending angularly outward away from the shaft adjoining a straight outer end wall, a triangular protrusion 24 having two straight side walls extending angularly outward from the bottom edge converging at an apex, a truncated triangular protrusion 25 having two straight side walls diverging angularly outward from the bottom edge terminating at a straight outer end wall, or may be an outwardly curved or convex arcuate protrusion 26. It should be understood that the juncture of the walls of the protrusions may be smoothly rounded to avoid sharp edges.

The dimensions of the protrusion(s) are generally 0.25 inches wide as measured tangentially at their juncture with the bottom edge 12 of the paddle blade and 0.25 inches in length as measured normal to the bottom edge of the paddle blade. However, it should be understood that either or both protrusion dimensions may be increased or decreased from the referenced 0.25 inches. The thickness of the protrusions may be the same as the thickness of the paddle blade (as measured at the bottom longitudinal edge of the paddle blade), or may be increased or decreased.

FIG. 4C illustrates a modification of the paddle blade embodiment of FIGS. 4A and 4B having a plurality of adjacent protrusions at locations along a portion of the bottom edge 12 of the blade that jut laterally outward a distance beyond the periphery thereof. For purposes of example, three adjacent square protrusions 20 having two straight parallel side walls adjoining a straight end wall is shown. However, it should be understood that the plurality of protrusion may comprise any of the shapes described previously, or combinations thereof.

Increasing the number of protrusions allows further discretion as to where the water is diverted and removed from the paddle blade. Protrusions located away from the paddle shaft will result in the removed water falling farther away from the paddler. Thus, the protrusion are preferably located along the middle portion of the longitudinal bottom edge 12 of the blade, however, it should be understood that the protrusions may be located on the longitudinal bottom edge near its juncture with the shaft of the paddle, or at least one protrusion located at the juncture of the shaft and the longitudinal bottom edge of the blade.

Combination of Notches and Protrusions

FIG. 5 illustrates another modification of the paddle blade 11 of the single or double bladed watercraft paddle 10 having a combination of adjacent notches and protrusions selected from the embodiments of FIGS. 3A and 3B, and FIGS. 4A and 4B, such as for example, but not limited thereto, a square notch 13 having two straight parallel side walls adjoining a straight end wall, a square protrusion 20 having two straight parallel side walls extending outwardly from the longitudinal bottom edge 12 of the blade 11 and terminating in a straight end wall, and a triangular protrusion 24 having two straight side walls extending angularly outward from the bottom edge of the blade 12 converging at an apex near its juncture with the shaft S.

Operation

Figure 2:
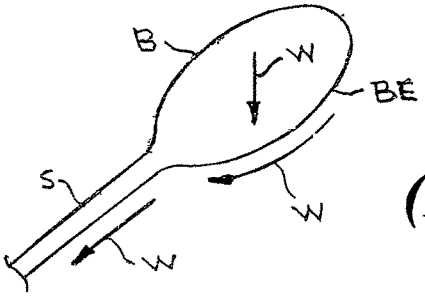
Fig. 2 (Prior Art)
FIG. 2 is a side elevation view of one end of a conventional single or double bladed kayak paddle in a raised position illustrating the direction of water flow when the paddle blade is raised out of the water.

As discussed above with reference to FIG. 2, when the paddle blade is elevated from the water above a horizontal plane, water will cohere to the paddle blade from whence it will flow downward along the paddle blade to the longitudinal bottom edge of the paddle blade B. When the paddle shaft is raised angularly above a horizontal position, the water on the elevated paddle blade will continue to flow vertically and accumulate on the bottom edge of the paddle blade from whence it will continue to flow toward the outer edge of the corresponding paddle shaft. If unaffected, the water from the elevated paddle blade will continue flow down the paddle shaft onto the paddler, and/or the paddler's hands, and/or the watercraft.

It should be understood from the foregoing that a paddle blade having notch(s) and protrusion(s) or combinations thereof in accordance with the present along the longitudinal bottom edge overcomes the aforementioned problem by diverting water flow off of a raised paddle blade to reduce the likelihood of it flowing or dripping into the watercraft, onto the paddler, or onto the paddler's hands. The quantity of water removed at each notch or protrusion may depend upon the quantity and location of the notch(s) or protrusion(s), the paddler's style, and the water physical properties.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A watercraft paddle for use by a paddler in propelling a human powered watercraft, comprising:

a paddle selected from the group consisting of a double blade paddle having a blade affixed at opposed ends of an elongate shaft, and a single blade paddle having a blade affixed at one end of an elongate shaft, the shaft of sufficient length to be gripped by hands of the paddler, the blade having a longitudinal top edge and a longitudinal bottom edge; and at least one protrusion disposed at a location along a portion of the longitudinal bottom edge of the blade that juts laterally outward a distance beyond the periphery of the longitudinal bottom edge configured to divert water off of the blade in a direction outwardly and away from the longitudinal bottom edge of the blade when the blade is raised and the elongate shaft gripped by the hands of the paddler is disposed angularly relative to a horizontal position and thereby reduce likelihood of water flowing or dripping off of the raised blade into the human powered watercraft, onto the paddler, or onto the hands of the paddler.

2. The watercraft paddle according to claim 1, wherein said at least one protrusion is selected from the group consisting of a square or rectangular protrusion having two straight parallel side walls that jut laterally outward from the longitudinal bottom edge of the blade and terminate in a straight outer end wall, a wedge shaped protrusion having two straight side walls that jut laterally outward from the longitudinal bottom edge of the blade and angularly toward each other and terminate in a straight outer end wall, a trapezoidal protrusion having two straight parallel side walls that jut angularly and laterally outward from the longitudinal bottom edge of the blade in a direction toward the elongate shaft and adjoin a straight outer end wall, a trapezoidal protrusion having two straight parallel side walls that jut angularly and laterally outward from the longitudinal bottom edge of the blade in a direction away from the elongate shaft and adjoin a straight outer end wall, a triangular protrusion having two straight side walls that jut angularly and laterally outward from the bottom edge of the blade converging at an apex, a truncated triangular protrusion having two straight side walls diverging angularly and laterally outward from the bottom edge of the blade terminating at a straight outer end wall, a convex arcuate protrusion that juts laterally outward away from the bottom edge of the blade, and a combination thereof.

3. The watercraft paddle according to claim 2, wherein said straight side walls and said straight outer end wall of said at least one protrusion that juts laterally outward from the longitudinal bottom edge of the blade are adjoined by a smoothly rounded juncture to avoid sharp edges.

4. The watercraft paddle according to claim 2, wherein said at least one protrusion that juts laterally outward from the longitudinal bottom edge of the blade comprises a plurality of protrusions disposed in laterally spaced apart relation along the longitudinal bottom edge of the blade.

5. The watercraft paddle according to claim 2, wherein said at least one protrusion that juts laterally outward from the longitudinal bottom edge of the blade comprises a protrusion disposed at a juncture of the elongate shaft and the longitudinal bottom edge of the blade that juts angularly outward beyond the juncture of the elongate shaft and longitudinal bottom edge of the blade.

* * * * *